US011236449B2

(12) United States Patent
Kilgore et al.

(10) Patent No.: US 11,236,449 B2
(45) Date of Patent: Feb. 1, 2022

(54) STITCHING SYSTEM FOR A SHOE UPPER

(71) Applicant: NIKE, Inc., Beaverton, OR (US)

(72) Inventors: Sara Kilgore, Portland, OR (US); Kassio Figur, Portland, OR (US)

(73) Assignee: NIKE, INC., Beaverton, OR (US)

( * ) Notice: Subject to any disclaimer, the term of this patent is extended or adjusted under 35 U.S.C. 154(b) by 129 days.

(21) Appl. No.: 16/424,087

(22) Filed: May 28, 2019

(65) Prior Publication Data

US 2019/0368092 A1 Dec. 5, 2019

Related U.S. Application Data

(60) Provisional application No. 62/678,674, filed on May 31, 2018.

(51) Int. Cl.

| | |
|---|---|
| ***D05B 15/02*** | (2006.01) |
| ***D05B 3/12*** | (2006.01) |
| ***D05B 19/10*** | (2006.01) |
| ***D05B 29/06*** | (2006.01) |

(52) U.S. Cl.

CPC ..... *D05B 15/02* (2013.01); *D05B 3/12* (2013.01); *D05B 19/10* (2013.01); *D05B 29/06* (2013.01)

(58) Field of Classification Search

CPC .... D05B 15/00–10; D05B 3/12; D05B 19/00; D05B 19/10; D05B 29/06; D05B 21/00; D05B 31/00; D05B 31/02; D05B 35/00; D05B 35/10; D05B 39/00

See application file for complete search history.

(56) References Cited

U.S. PATENT DOCUMENTS

| | | | | |
|---|---|---|---|---|
| 1,569,231 A * | 1/1926 | Mayo | A43B 9/00 12/146 C |
| 4,336,761 A * | 6/1982 | Magnan | D05B 39/00 112/317 |
| 4,455,952 A * | 6/1984 | Morin | D05B 31/00 112/102 |
| 4,510,876 A * | 4/1985 | Garley | D05B 39/00 112/121 |

(Continued)

FOREIGN PATENT DOCUMENTS

| | | |
|---|---|---|
| FR | 2646328 A1 * | 11/1990 |
| KR | 20120079248 A | 7/2012 |

(Continued)

OTHER PUBLICATIONS

International Search Report and Written Opinion dated Sep. 19, 2019 in International Patent Application No. PCT/US2019/034412, 22 pages.

(Continued)

*Primary Examiner* — Ismael Izaguirre

(74) *Attorney, Agent, or Firm* — Shook Hardy & Bacon, LLP

(57) ABSTRACT

A stitching system includes a jig capable of joining two shoe parts and capable of being used in an automated stitching machine. The jig includes a lower member capable of being operably coupled to the automated stitching machine and an upper member also capable of being operably coupled to the automated stitching machine. The two shoe parts are held in place between the lower member and the upper member. The lower member, the upper member and the two shoe parts therebetween are moved by the automated stitching machine in accordance with a pattern stored in the automated stitching machine.

19 Claims, 12 Drawing Sheets

(56) References Cited

U.S. PATENT DOCUMENTS

| | | | | | |
|---|---|---|---|---|---|
| 4,587,910 | A * | 5/1986 | Raines | D05B 39/00 | 112/148 |
| 4,593,634 | A * | 6/1986 | Moreno | D05B 31/00 | 112/470.06 |
| 4,639,964 | A * | 2/1987 | Binder | D05B 39/00 | 112/470.14 |
| 4,694,766 | A * | 9/1987 | Wickers | D05B 31/00 | 112/470.14 |
| 5,005,501 | A * | 4/1991 | Kita | D05B 21/00 | 112/102.5 |
| 5,377,605 | A * | 1/1995 | Frye | D05B 39/00 | 112/102.5 |
| 5,520,129 | A | 5/1996 | Porter et al. | | |
| 6,336,416 | B1 * | 1/2002 | French | D05C 9/04 | 112/103 |
| 6,755,141 | B2 * | 6/2004 | Musco | D05B 15/02 | 112/470.07 |
| 2008/0276849 | A1 * | 11/2008 | Mack | D05C 9/04 | 112/103 |

FOREIGN PATENT DOCUMENTS

| | | | |
|---|---|---|---|
| KR | 20130133428 | A | 12/2013 |
| KR | 101852877 | B1 | 4/2018 |

OTHER PUBLICATIONS

International Preliminary Report on Patentability received for PCT Patent Application No. PCT/US2019/034412, dated Dec. 10, 2020, 8 pages.

* cited by examiner

STITCHING SYSTEM FOR A SHOE UPPER

This application claims the benefit of priority of U.S. Application No. 62/678,674, titled "Stitching System for a Shoe Upper," and filed May 31, 2018. The entirety of the aforementioned application is incorporated by reference herein.

TECHNICAL FIELD

Aspects hereof relate to apparatuses, systems and methods for automated stitching of components/parts of a shoe upper to be incorporated into articles of footwear, e.g., shoes. More particularly, aspects relate to apparatuses, systems and methods for automatically stitching two shoe upper parts together to form a portion of a shoe upper.

BACKGROUND

Articles of footwear and, in particular, shoes may be made by combining components, such as uppers and bottom units (comprising a midsole and an outsole), which may themselves be comprised of subcomponents. For instance, a shoe upper may be comprised of multiple planar parts that are cut from different stock pieces of material, for example, but not limited to, an exterior upper and a heel liner. The exterior upper may be made of a material that is more wear resistant and the heel liner may be made of a material that is more comfortable to the foot of a wearer. These shoe parts are then stitched together utilizing a manual stitching machine. The shoe upper parts, such as the exterior upper and the heel liner, are required to be skillfully manipulated by a worker to form the seams of a resulting upper.

BRIEF SUMMARY

Aspects hereof provide a jig capable of joining two shoe parts and capable of being used in an automated stitching machine. The jig includes a lower member capable of being operably coupled to the automated stitching machine and an upper member capable of being operably coupled to the automated stitching machine. The two shoe parts are held in place between the lower member and the upper member. The lower member, the upper member and the two shoe parts therebetween are moved by the automated stitching machine in accordance with a pattern stored in the automated stitching machine.

Another aspect hereof provides a system for stitching two parts of a shoe together. The system includes a stitching machine including a head with a needle. The system further includes a positioning mechanism coupled to the stitching machine. The positioning mechanism is capable of moving along an X-axis and a Y-axis. A planer jig is provided for positioning the two shoe parts with respect to one another and removably coupled to the positioning mechanism. A computing device is provided for controlling actuation of the needle head and the positioning mechanism such that the jig can be manipulated to provide a specific stitch arrangement for connecting the two shoe parts. The jig includes an edge at a location distal from the positioning mechanism and having a configuration that follows the general shape of the specific stitch arrangement for connecting the two shoe parts.

A further aspect provides a method of joining two shoe parts together in a specific fashion. The method includes providing a stitching machine with a two axis positioning mechanism. The method includes coupling a planar jig to the two axis drive mechanism. The method further includes securing the two shoe parts to the planar jig with the use of pins and accessing a pattern from a computing device of the stitching machine. The pattern represents the stitch line for joining the two shoe parts together. The method includes joining the two shoe parts together based upon the pattern.

DESCRIPTION OF THE DRAWINGS

The present invention is described in detail herein with reference to the attached drawing figures, wherein.

DETAILED DESCRIPTION

Figure 1:
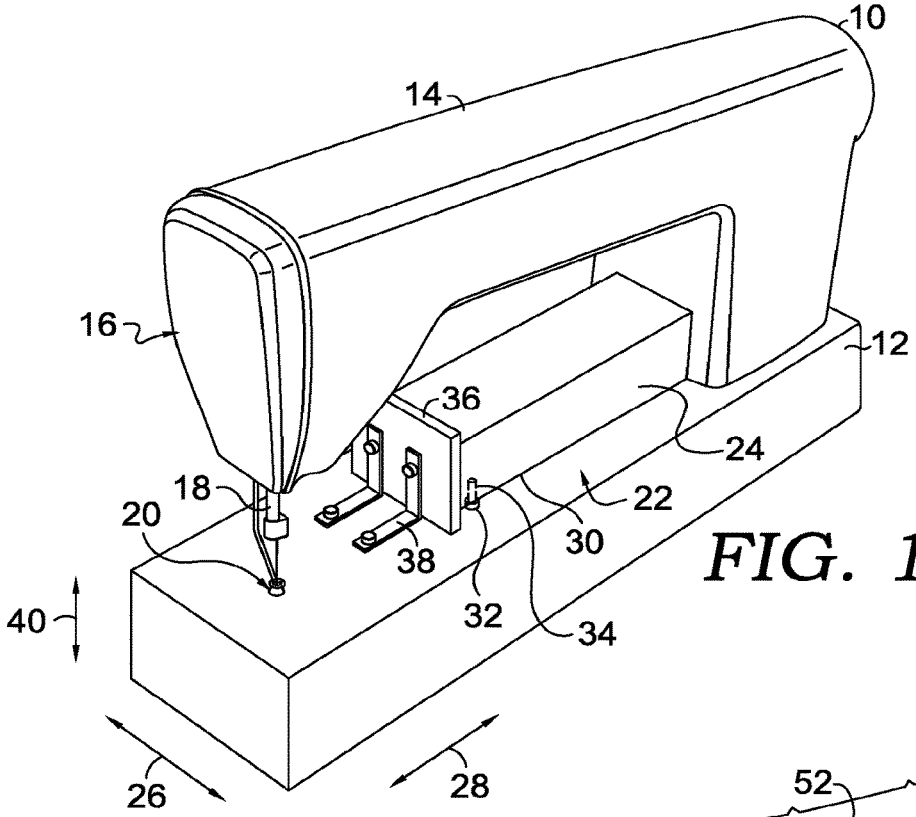
FIG. 1 depicts a top perspective view of a known automated stitching machine with an X-Y axis positioning mechanism.

As a result of the desires for protection and support from an upper, cushioning from a midsole, and traction and durability from an outsole, a given shoe may utilize diverse materials and structural designs for these different components. Further, additional components that provide, for example, particularized impact protection, motion control for pronation or supination, varying degrees of support, additional impact protection, and the like may further complicate the design of all or part of a shoe. Nevertheless, these components must be ultimately integrated to form a wearable shoe that is both functional and, ideally, attractive. Shoes may be made by combining components, such as uppers and bottom units (comprising a midsole and an outsole), which may themselves be comprised of subcomponents. For instance, a shoe upper may be comprised of multiple planar parts that are cut from different stock pieces of material, for example, but not limited to, an exterior upper and a heel liner. The exterior upper may be made of a material that is more wear resistant and the heel liner may be made of a material that is more comfortable to the foot of a wearer. These shoe parts are then stitched together utilizing a manual stitching machine. The shoe upper parts, such as the exterior upper and the heel liner, are required to be skillfully manipulated by a worker to form the collar seam of a resulting upper. The exterior upper may comprise an integrally formed medial part and a lateral part that have back edges manually stitched together to form the closed collar region of the upper. The above manual stitching operations are very labor intensive and creates great inefficiencies in the manufacturing of shoes. Additionally, because each worker may stitch in a different manner, this type of manual manufacturing may also create inconsistencies between shoes of the same model and type. These inconsistencies may be visually perceptible to a buyer and can also result in rejected shoes as part of the inspection process.

Aspects hereof provide a jig capable of joining two shoe parts and capable of being used in an automated stitching machine. The jig includes a lower member capable of being operably coupled to the automated stitching machine and an upper member capable of being operably coupled to the automated stitching machine. The two shoe parts are held in place between the lower member and the upper member. The lower member, the upper member and the two shoe parts therebetween are moved by the automated stitching machine in accordance with a pattern stored in the automated stitching machine.

Another aspect hereof provides a system for stitching two parts of a shoe together. The system includes a stitching machine including a head with a needle. The system further includes a positioning mechanism coupled to the stitching machine. The positioning mechanism is capable of movement along an X-axis and a Y-axis. A planer jig is provided for positioning the two shoe parts with respect to one another and removably coupled to the positioning mechanism. A computing device is provided for controlling actuation of the needle head and the positioning mechanism such that the jig can be manipulated to provide a specific stitch arrangement for connecting the two shoe parts. The jig includes an edge at a location distal from the positioning mechanism and having a configuration that follows the general shape of the specific stitch arrangement for connecting the two shoe parts.

A further aspect provides a method of joining two shoe parts together in a specific fashion. The method includes providing an automated stitching machine with a two axis positioning mechanism. The method includes coupling a planar jig to the two axis positioning mechanism. The method further includes securing the two shoe parts to the planar jig with the use of pins and accessing a pattern from a computing device of the automated stitching machine. The pattern represents the stitch line for joining the two shoe parts together. The method includes joining the two shoe parts together based upon the pattern.

Referring to FIG. 1 a known automated stitching machine 10 is depicted. The stitching machine 10 includes a base 12 that supports an upstanding arm 14. The arm 14 has a stitching head 16 positioned there on for performing a stitching operation. The stitching head 16 includes a presser foot arrangement 18 which also includes a needle (not shown). The presser foot arrangement 18 is positioned above an aperture 20 in the base 12. The aperture 20 receives a needle of the presser foot arrangement 18 in order to effectuate a stitching operation. An article or multiple articles to be stitched are supported and moved along the base 12 by a horizontal X-axis, Y-axis positioning mechanism 22. The positioning mechanism 22 has an arm 24 that is capable of being automatically moved in a horizontal X direction 26 and a horizontal Y direction 28. The positioning mechanism 22 is controlled by a suitable computing device to move an article or articles to be stitched in both the X direction 26 and the Y direction 28 below the stitching head 16. In this manner, a particular stitching operation can be performed based upon a pattern stored in a suitable computing device. The computing device automatically controls the positioning mechanism 22 and the stitching head 16 to perform a specific stitch arrangement that has been stored in a memory of the computing device. The arm 24 of the positioning mechanism 22 is moved in a known manner in both the directions 26 and 28 by suitable actuators (not shown). The positioning mechanism 22 also includes a lower jig support surface 30 that is coupled to a lower jig (as will be more fully described herein) via bolts/screws/pins 32 received in apertures 34 (shown in phantom) formed in the arm 24. The bolts 32 allow a lower jig to be removably attached to the arm 24. The arm 24 also has an actuatable upper jig attachment plate 36 that is coupled to a lower jig as will be more fully described herein. The attachment plate 36 has a pair of L-shaped brackets 38 that are used to removably connect the attachment plate 36 to an upper jig. The plate 36 is automatically movable in an up and down direction 40 by a suitable actuator (not shown) controlled by a computing device. The actuation of the plate 36 in an upper direction 40 serves to allow an operator to position one or more articles to be stitched between an upper and lower jig because the jigs are separated from one another in this raised position. The actuation of plate 36 in a downward direction 40 serves to secure the one or more articles to be stitched by moving the upper jig closer to the lower jig to pinch and secure the article therebetween for an upcoming automated stitching operation.

One such suitable known stitching machine is the Model AMS-210EN-1306 Computer-controlled Cycle Machine manufactured by Juki Corporation.

Figure 2:
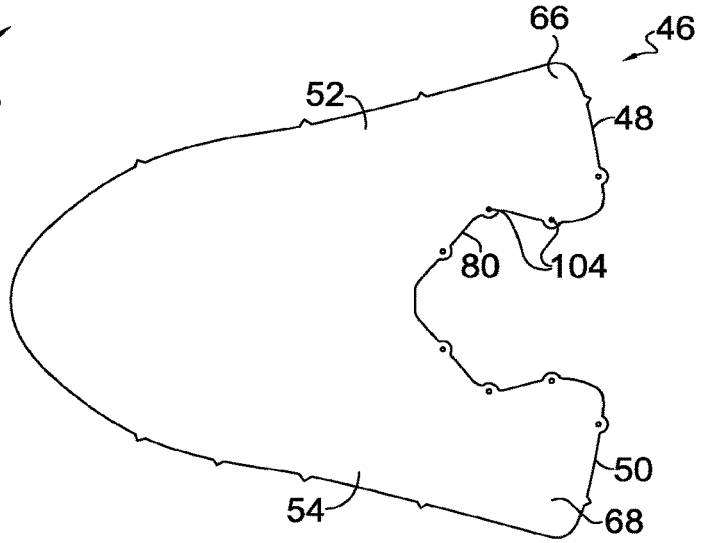
FIG. 2 depicts a top plan view of a shoe upper component in the form of an exterior upper including a medial part and a lateral part integrally formed together, in accordance with exemplary aspects hereof.
Figure 3:
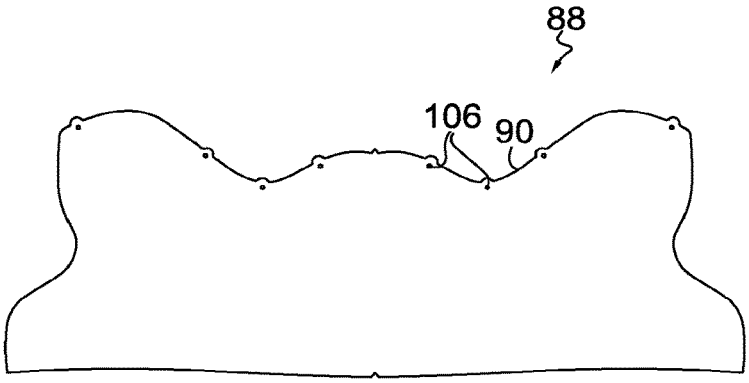
FIG. 3 depicts a top plane view of a shoe upper component in the form of a heel liner part, in accordance with exemplary aspects hereof.
Figure 4:
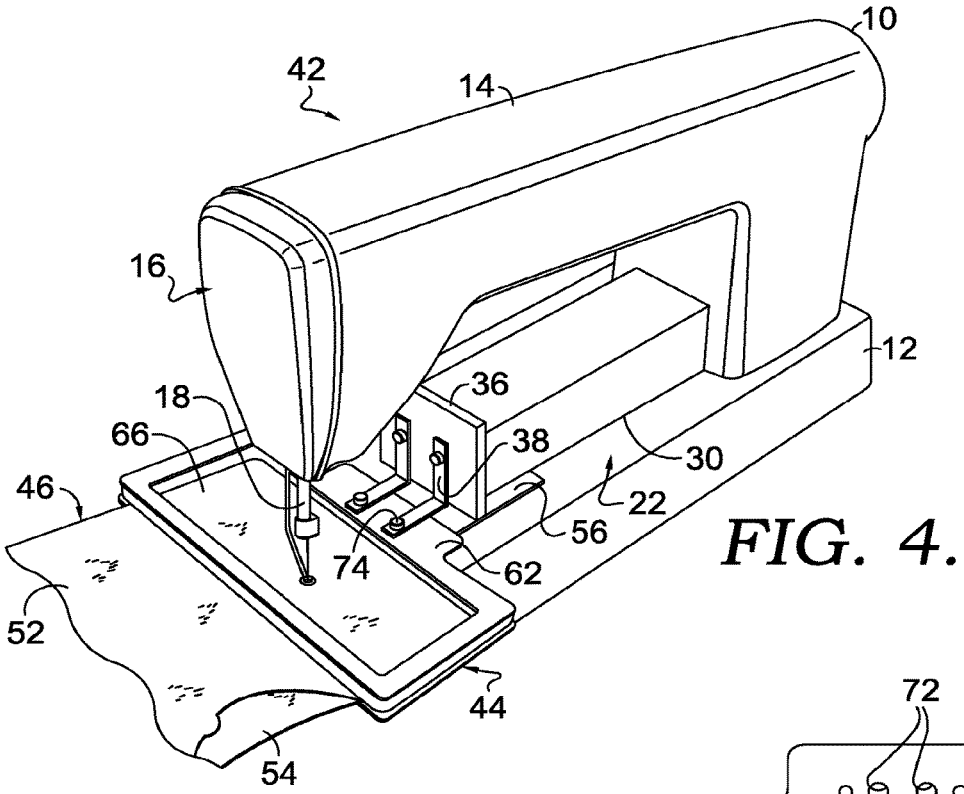
FIG. 4 depicts a top perspective view of a system capable of automatically stitching two shoe parts together including a jig to form a center back seam, in accordance with exemplary aspects hereof.
Figure 6:
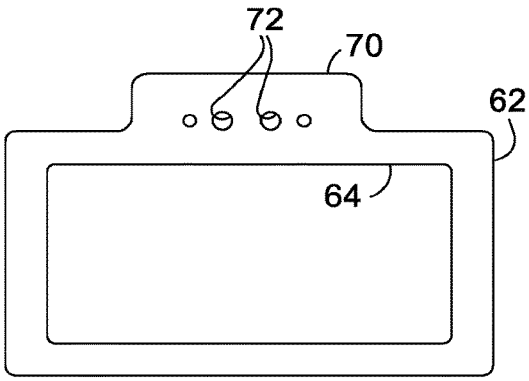
FIG. 6 depicts a top plan view of the upper member of the jig of FIG. 4, in accordance with exemplary aspects hereof.
Figure 5:
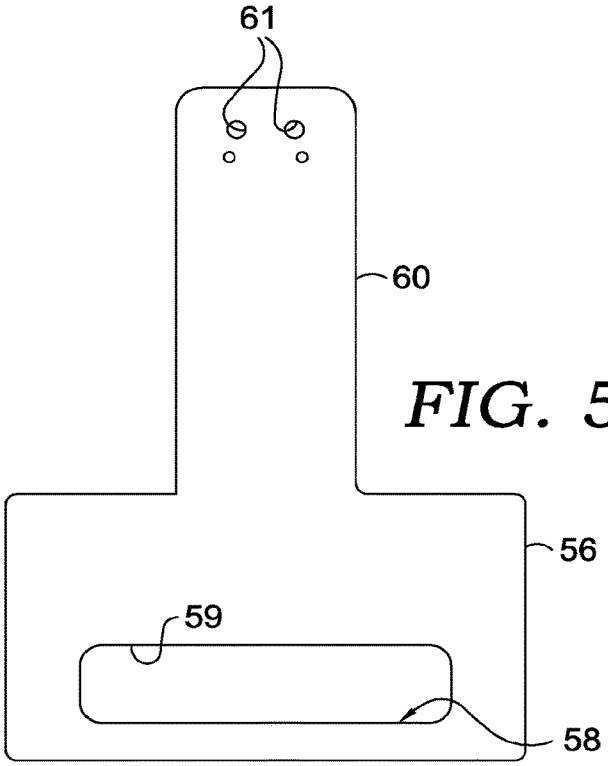
FIG. 5 depicts a top plan view of the lower member of the jig of FIG. 4, in accordance with exemplary aspects hereof.
Figure 7:
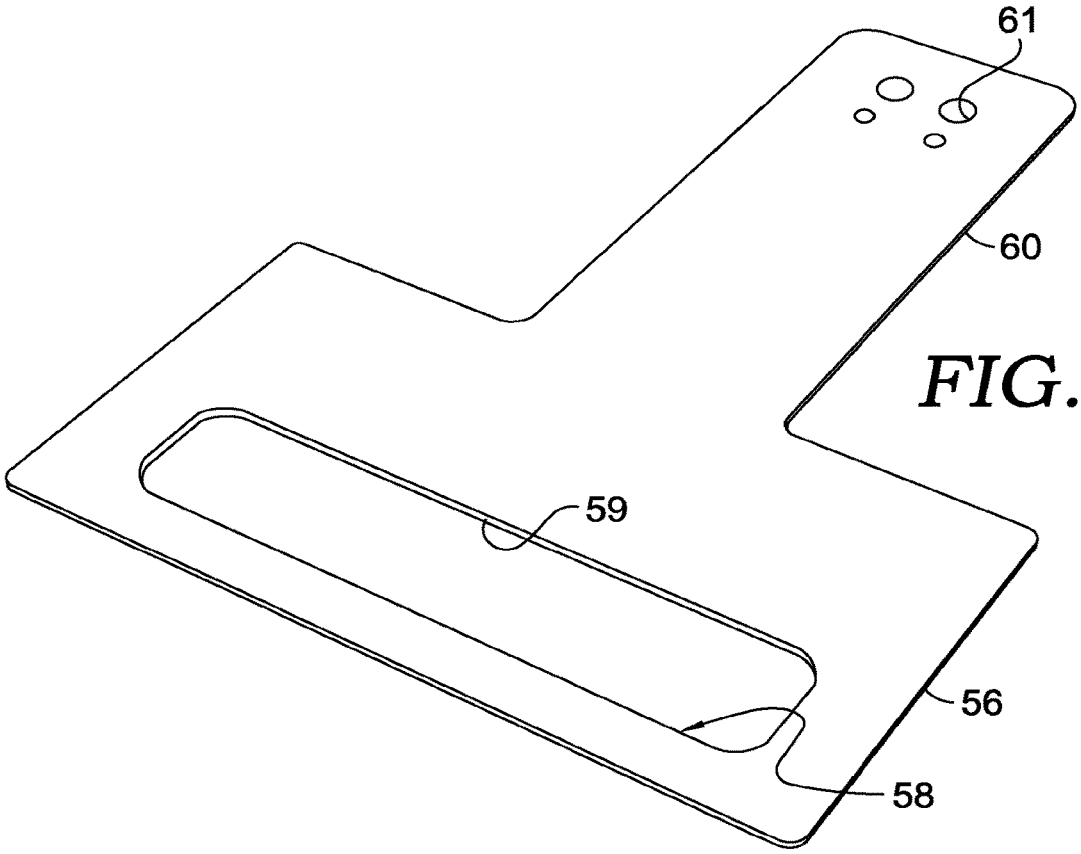
FIG. 7 depicts a top perspective view of the jig lower member of FIG. 5, in accordance with exemplary aspects hereof.

Referring to FIGS. 2, and 4-10, in accordance with aspects hereof, a system 42 with a jig 44 for automatically effectuating the back seam of a shoe upper 46 will be described. Referring to FIG. 2, a shoe upper 46 can be cut out of a larger piece of desired stock material or formed to shape such that the upper can have the shape depicted in FIG. 2. In this manner, for instance, the upper 46 is generally symmetrical and a closed shoe upper can be formed by joining the back edges 48 and 50 together by stitching. Joining the back edges 48 and 50 can be accomplished by folding one medial part 52 of one piece upper 46 onto the other lateral part 54 of the one piece upper 46 so that the back edges 48 and 50 align with one another. Referring to FIG. 4, it is this overlapping arrangement of parts 52 and 54 and edges 48 and 50 that is positioned in the jig 44 and manipulated by the machine 10 to form a back seam of the upper 46, as will be more fully described herein.

Referring to FIGS. 4-10, in accordance with aspects hereof, the jig 44 will be described. The jig 44 has a planer lower member 56 that has a stitching aperture 58 formed therein. The aperture 58 is generally rectangular in shape and elongated and generally matches the resulting stitch line that is used to form the back seam of the upper 46. Still further, the aperture 58 is formed at least partially by an internal edge 59 that also has the general path/shape of a resulting stitch line that is used to form the back seam of the upper 46. The presser foot arrangement 18 operates within the aperture 58 to perform the joining operation of back edges 48 and 50 to form the back seam. The lower jig member 56 also has a planar connecting flange 60 with connecting apertures 61 formed therein that is capable of being removably coupled to the support surface 30 of the arm 24 by bolts 32. In this manner, as positioning mechanism 22 is automatically manipulated in the X direction 26 and the Y direction 28, so is the lower member 56.

The jig 44 also has a planar upper member 62 that has a stitching aperture 64 formed therein. The aperture 64 is also rectangular in shape, but is larger than the aperture 58 of the lower member 56. The aperture 64 is substantially larger than the aperture 58 in the width direction and slightly larger than the aperture 58 in the length direction. The provision of the larger aperture 64 in the upper member 62 allows the presser foot arrangement 18 to more easily engage the portions 66 and 68 of the shoe upper parts 52 and 54, respectively, that are adjacent the back edges 48 and 50. The smaller aperture 58 of the lower member 46 acts to support the parts 52 and 54 during stitching and also ensures adequate securement of the portions 66 and 68. The jig upper member 62 also has a connecting flange 70 with connecting apertures 72 formed therein that is capable of being removably attached to the L-shaped brackets 38 of the plate 36 by suitable bolts 74. In this manner, as positioning mechanism 32 is automatically manipulated in the X direction 26 and the Y direction 28, so is the upper member 62. Additionally, as described herein, the plate 36 is capable of being automatically actuated in the upwardly/downwardly direction 40 so that the shoe upper portions 66 and 68 can be automatically pinched/secured between the jig lower member 56 and the jig upper member 62 prior to the automated stitching operation.

Figure 8:
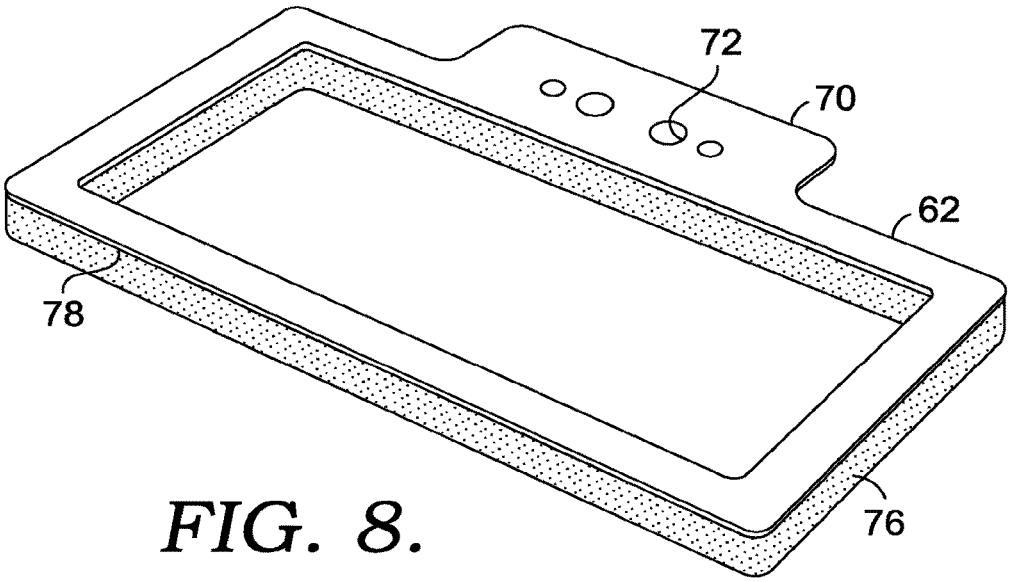
FIG. 8 depicts a top perspective view of the jig upper member of FIG. 6, in accordance with exemplary aspects hereof.
Figure 9:
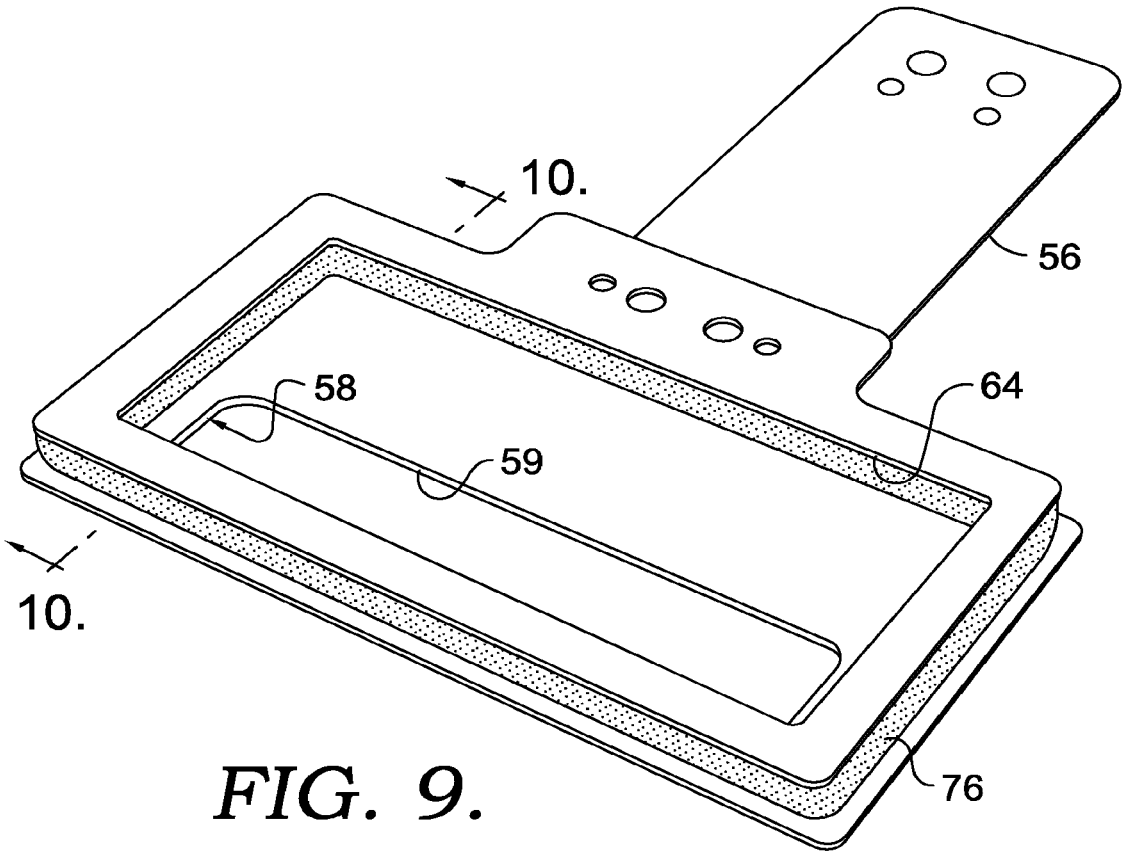
FIG. 9 depicts a top perspective view of the jig of FIG. 4 showing the relative operational positions of the jig lower member and the jig upper member, in accordance with exemplary aspects hereof.
Figure 10:
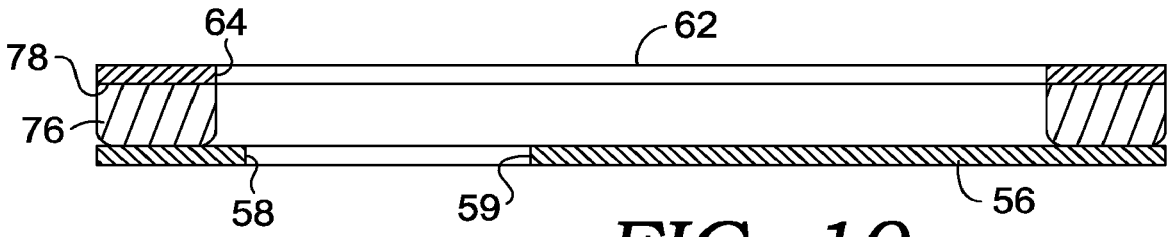
FIG. 10 depicts a cross section taken along line 10-10 of FIG. 9, in accordance with exemplary aspects hereof.

Referring to FIGS. 8-10, the jig upper member 62 has a compressible securement layer 76 attached to a lower surface 78 of the upper member 62 and surrounding the rectangular aperture 64. The layer 76 can be formed of any suitable compressible material, for instance, but not limited to a memory foam. As the jig upper member 62 is moved towards the jig lower member 56 by the downwardly actuation of plate 36, the layer 76 is compressed to help secure the portions 66 and 68 of the upper 46 therebetween. In this manner, it has been found that no additional securement means beyond the layer 76 and the downward pressure applied by the jig upper member 62 is needed to secure the upper 46 for movement by the positioning mechanism 22 during a stitching operation.

Referring to FIG. 4, once the upper 46 is folded over such that the parts 52 and 54 overlap and the portions 66 and 68 are secured in the jig 44, the stitching operation can automatically take place. A stitch pattern (not shown) can be loaded from the memory of a computing device electronically coupled to the stitching machine 10. The pattern will have the general configuration of the stitching aperture 58 of the jig lower member 56, which is also the general shape of the center back seam of a closed shoe upper. In the current example, the back seam is a straight line, but, as is apparent, any other sort of seam configuration could be used (for instance a zig-zag line or a curved line) by picking the appropriate pattern and a corresponding shape to the apertures 58 and 64. The positioning mechanism 22 and the stitching head 16 will be automatically actuated to perform a stitch operation based upon the pattern. More specifically, the positioning mechanism 22 will move the jig 44 in the desired X and Y directions 26 and 28 (based upon the pattern) below the stitching head 16 as it is actuated. The presser foot arrangement 18 operates in conjunction with the base aperture 20 to form the center back seam. Once the stitch operation is over, the jig upper member 62 will be automatically moved upwardly by the plate 36 so as to release the now closed upper 46 from the jig 44. What is meant by a closed upper is that the back edges 48 and 50 have been secured to one another, such that a closed collar region is formed along the collar edge 80 of the upper 46. The edges 48 and 50 of the upper 46 are joined in an inside out manner, such that when the upper is included in a final shoe product, the back center seam will be on the inside of the shoe. The upper 46 can be turned right side out at this point, or can remain inside out for further manufacturing steps and turned right side out after those further steps.

Referring to FIGS. 2, 3, and 11-20, in accordance with aspects hereof, a system 82 with a jigs 84 and 86 for automatically joining a heel liner 88 with a closed collar upper 46 to form a collar seam will be described. As described herein, a center back seem of a shoe upper can be formed by joining the back edges 48 and 50 together such that collar edge 80 of an upper is closed off to form the foot receiving opening of a resulting shoe. It may also be desirous to attach the closed upper 46 with a heel liner 88 along the collar edge 80 of the upper 46. The heel liner 88 also has a collar edge 90 that when joined to the closed collar edge 80 forms the collar seam of a resulting shoe. The system 82 utilizes two separate, but symmetrical jigs 84 and 86, in two separate stitching operations, to connect the upper collar edge 80 to the liner collar edge 90. The jig 84 is used to form one half of the collar seam (for instance, the medial side of the collar seam) and the jig 86 is used to form the other half of the collar seam (for instance, the lateral side of the collar seam). Because the jigs 84 and 86 are identical mirror images of one another, only the details of the jig 84 will be described.

Figure 17:
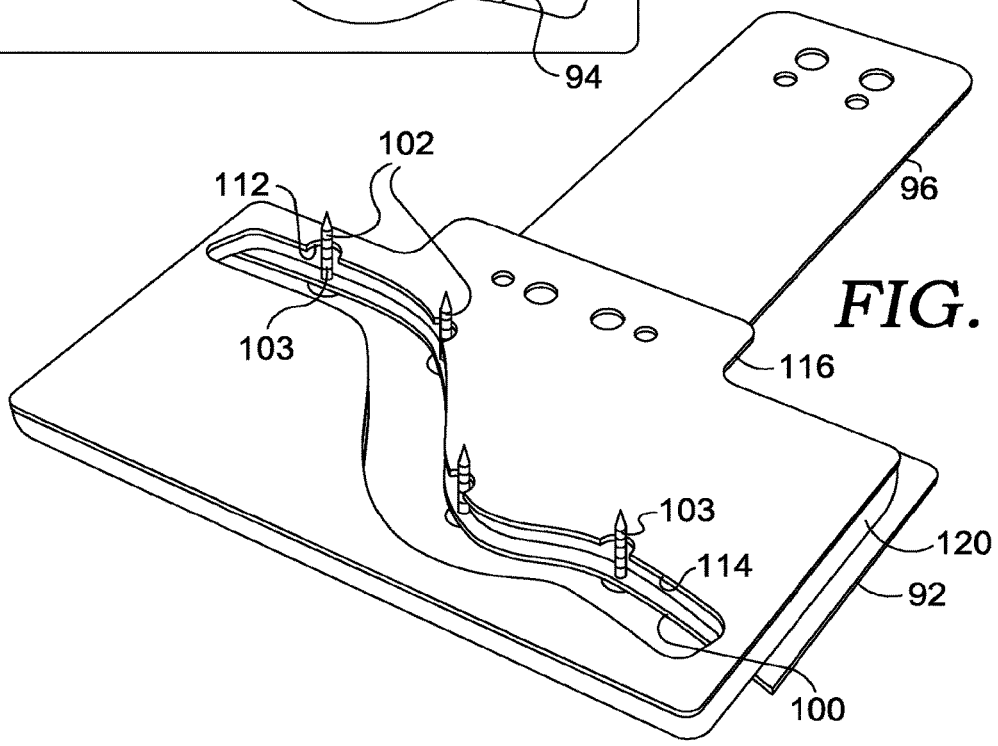
FIG. 17 depicts a top perspective view of the jig of FIG. 11 showing the relative operational positions of the jig lower member and the jig upper member, in accordance with exemplary aspects hereof.
Figure 18:
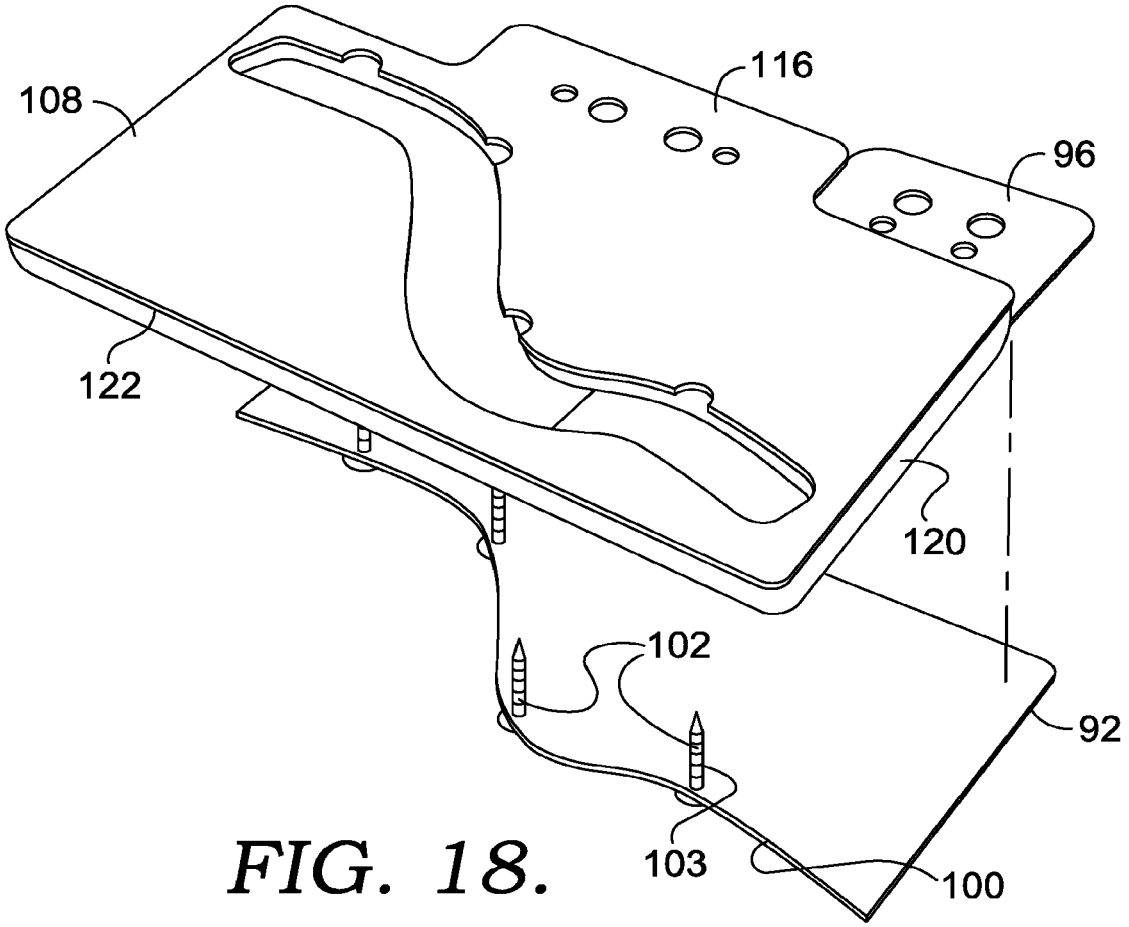
FIG. 18 depicts an exploded top perspective view of the jig of FIG. 11 showing the relative operational positions of the jig lower member and the jig upper member, in accordance with exemplary aspects hereof.
Figure 19:
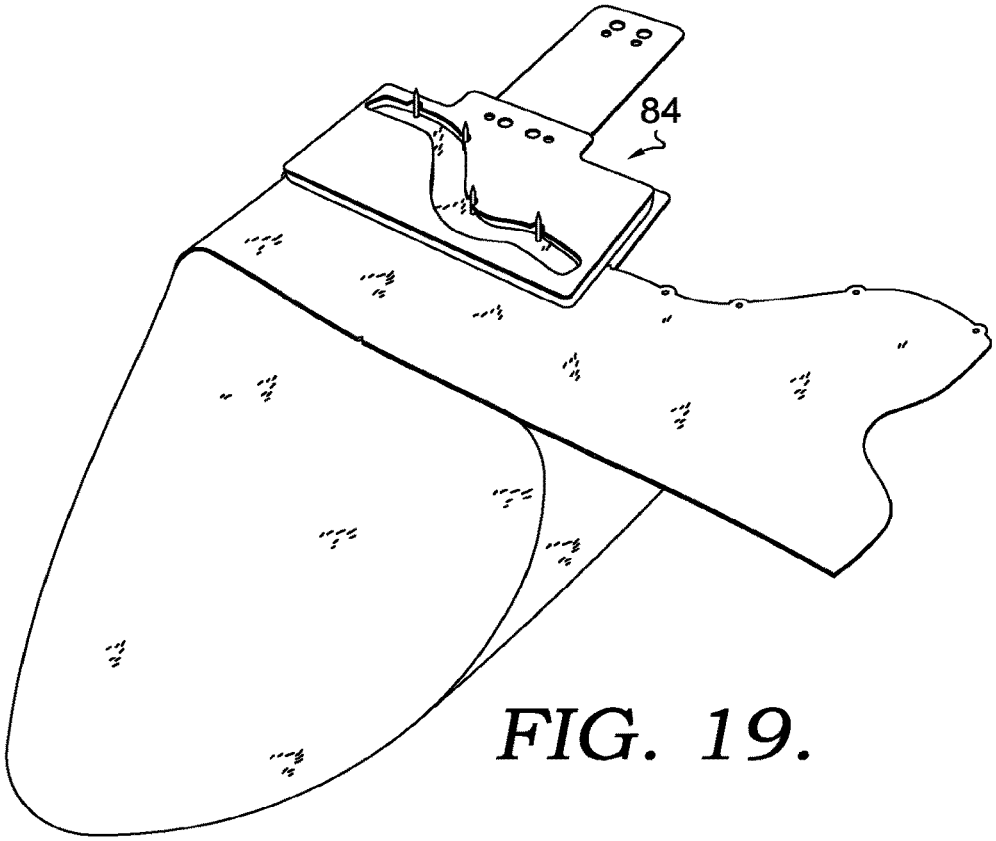
FIG. 19 depicts a top perspective view of the jig of FIG. 11 with the shoe upper and a heel liner secured thereto, in accordance with exemplary aspects hereof.

Referring to FIGS. 12-15, 17, and 18, in accordance with aspects hereof, the jig 84 will be described. The jig 84 has a planer lower member 92 that has a stitching edge 100 at a location that is distal from the positioning mechanism 22. The edge 100 is generally an elongated wave shape that generally matches the resulting stitch line that is used to form one half of the collar seam of a resulting shoe. The presser foot arrangement 18 operates adjacent to the edge 100 to perform one half of the joining operation of upper collar edge 80 and the liner collar edge 90 to form one half of the collar seam. The jig lower member 92 also has a planar connecting flange 96 with connecting apertures 98 formed therein that is capable of being removably coupled to the support surface 30 of the arm 24 by bolts 32. In this manner, as positioning mechanism 22 is automatically manipulated in the X direction 26 and the Y direction 28, so is the lower member 92. Positioned and spaced along edge 100 is a plurality of mounting pins 102. The mounting pins 102 are used to secure one half of the upper collar edge 80 and one half of the liner collar edge 90 to the jig lower member 92 during a stitching operation. More specifically, as will be described herein, the upper collar edge 80 has a plurality of mounting apertures 104 which are capable of receiving respective mounting pins 102. The apertures 104 can be formed when the upper 46 is cut out from a larger piece of stock material or when the upper 46 is, for instance, knit to shape, or formed in any other manner. The mounting pins 102 can have a threaded surface 103 that serves to assist the securement of the upper 46 and the liner 88 or any other component thereon. In addition to a threaded surface 103, the surface can have any other configuration that assists securement of a component on the pin 102 through friction, for example a barbed configuration or roughened surface configuration. Referring to FIG. 19, only one half of the apertures 104 corresponding to one half of the collar edge 80 are received on the pins 102 when the closed upper 46 is positioned on the jig 84. The liner collar edge 90 has a plurality of mounting apertures 106 which are capable of receiving respective mounting pins 102. The apertures 106 can be formed when the liner 88 is cut out from a larger piece of stock material or when the liner 88 is, for instance, knit to shape, or formed in any other manner. Referring to FIG. 19, only one half of the apertures 106 corresponding to one half of the collar edge 90 are received on the pins 102 when the liner 88 is positioned on the jig 84.

The jig 84 also has a planar upper member 108 that has a stitching aperture 110 formed therein. The aperture 110 generally has a general shape similar to the path/shape of edge 100 in that it has an elongated wave shape that generally matches the resulting stitch line that is used to form one half of the collar seam of a resulting shoe. An edge 114 of the jig upper member aperture 110 generally coincides with the jig lower member edge 100 when the jig members 92 and 108 are in an operational position as depicted in FIGS. 17 and 18. The aperture 110 also has a plurality of semi-circular cutouts 112 formed on the edge 114. The cutouts 112 align and received respective pins 102 when the jig lower member 92 and the jig upper member 108 are in an operational position. The jig upper member 108 also has a connecting flange 116 with connecting apertures 118 formed therein that is capable of being removably attached to the L-shaped brackets 38 of the plate 36 by suitable bolts 74. In this manner, as positioning mechanism 22 is automatically manipulated in the X direction 26 and the Y direction 28, so is the upper member 108. Additionally, as described herein, the plate 36 is capable of being automatically actuated in the upwardly/downwardly direction 40 so that the shoe upper 46 and the liner 88 can be automatically pinched/secured between the jig lower member 92 and the jig upper member 108 prior to the automated stitching operation.

Referring to FIGS. 17 and 18, the jig upper member 108 has a compressible securement layer 120 attached to a lower surface 122 of the jig upper member 108 and surrounding the elongated wave shaped aperture 110 and the cutouts 112. The layer 120 can be formed of any suitable compressible material, for instance, but not limited to a memory foam. As the jig upper member 108 is moved towards the jig lower member 92 by the downwardly actuation of plate 36, the layer 120 is compressed to help secure therebetween the portions of the upper 46 and the liner 88 adjacent one half of the upper collar edge 80 and one half of the liner collar edge 90. In addition to this clamping or pinching action, the securement of one half of the upper mounting apertures 104 and one half of the liner mounting apertures 106 on the pins 102 further secures the upper 46 and the liner 88 to the jig 84 for movement by the positioning mechanism 22 during a stitching operation.

Figure 11:
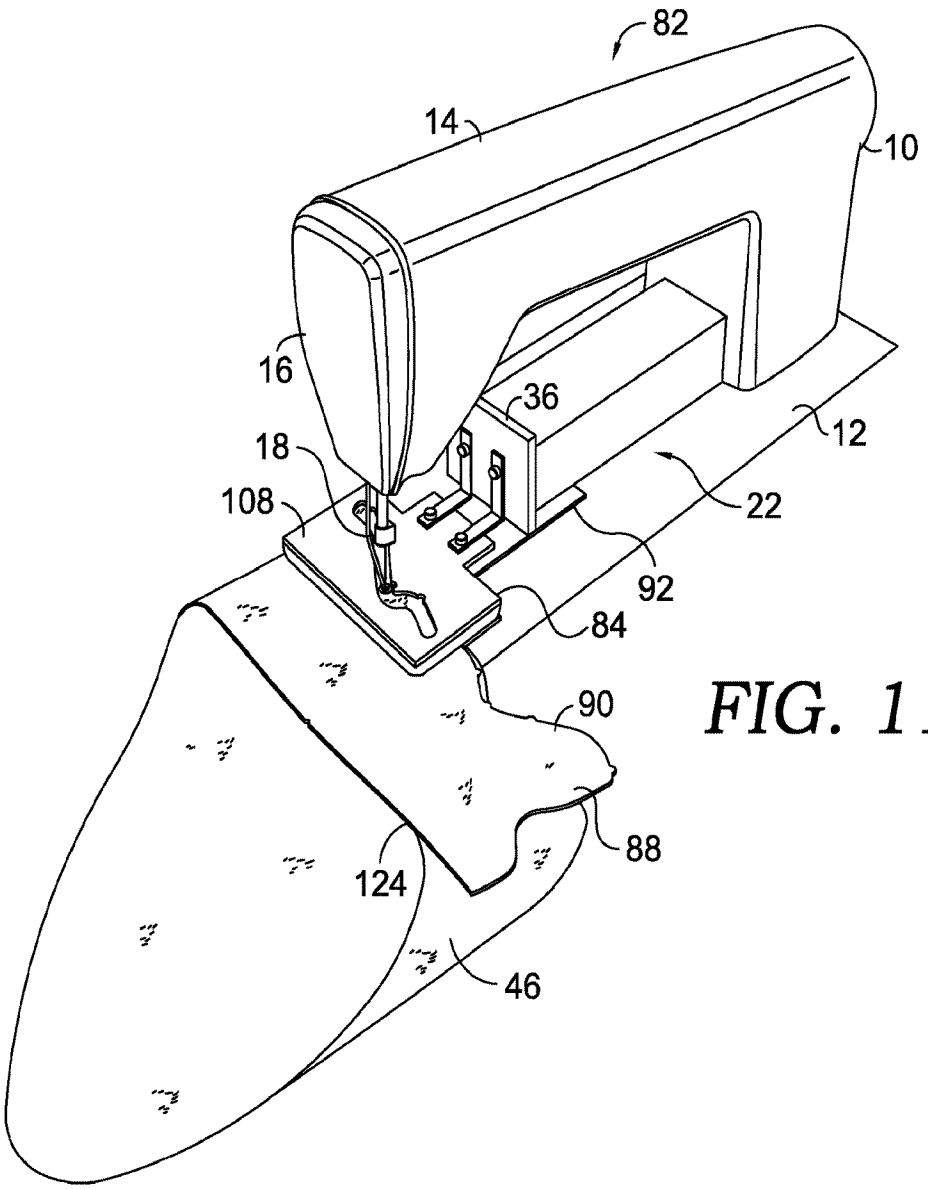
FIG. 11 depicts a top perspective view of a system capable of automatically stitching two shoe parts together including a jig to form a shoe collar seam, in accordance with exemplary aspects hereof.
Figure 12:
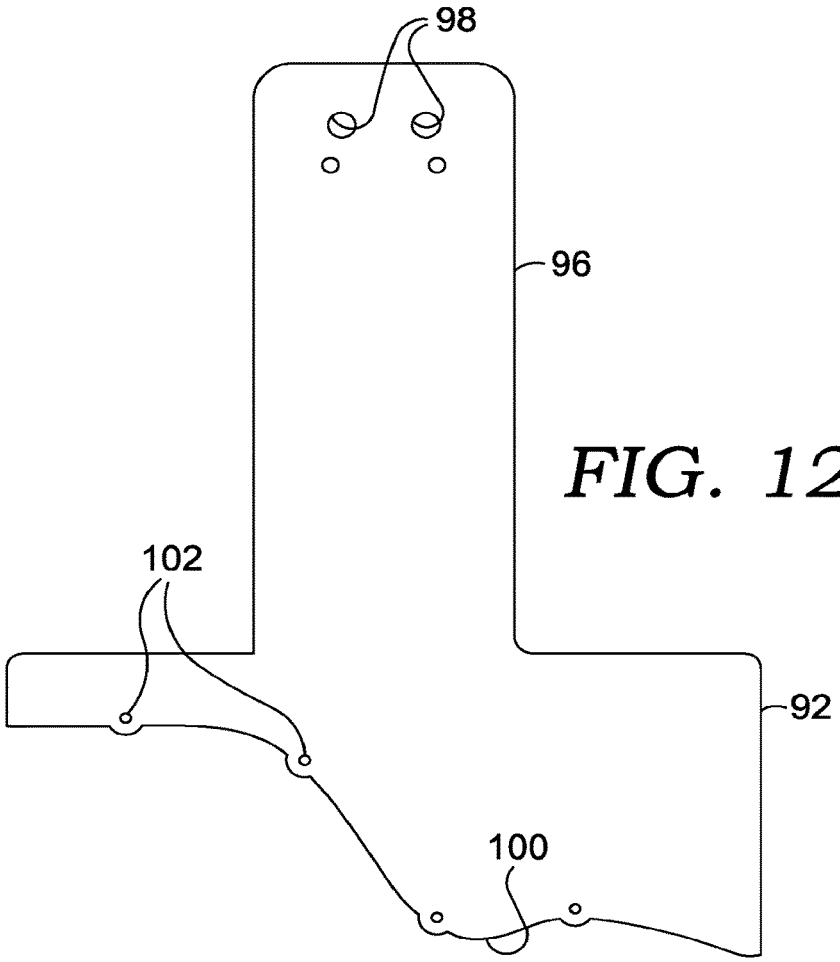
FIG. 12 depicts a top plan view of the lower member of the jig of FIG. 11, in accordance with exemplary aspects hereof.
Figure 13:
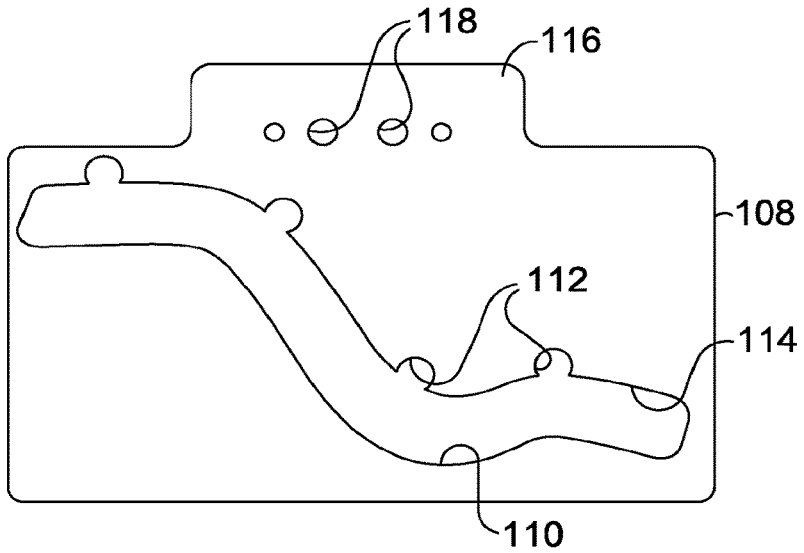
FIG. 13 depicts a top plan view of the upper member of the jig of FIG. 11, in accordance with exemplary aspects hereof.
Figure 20:
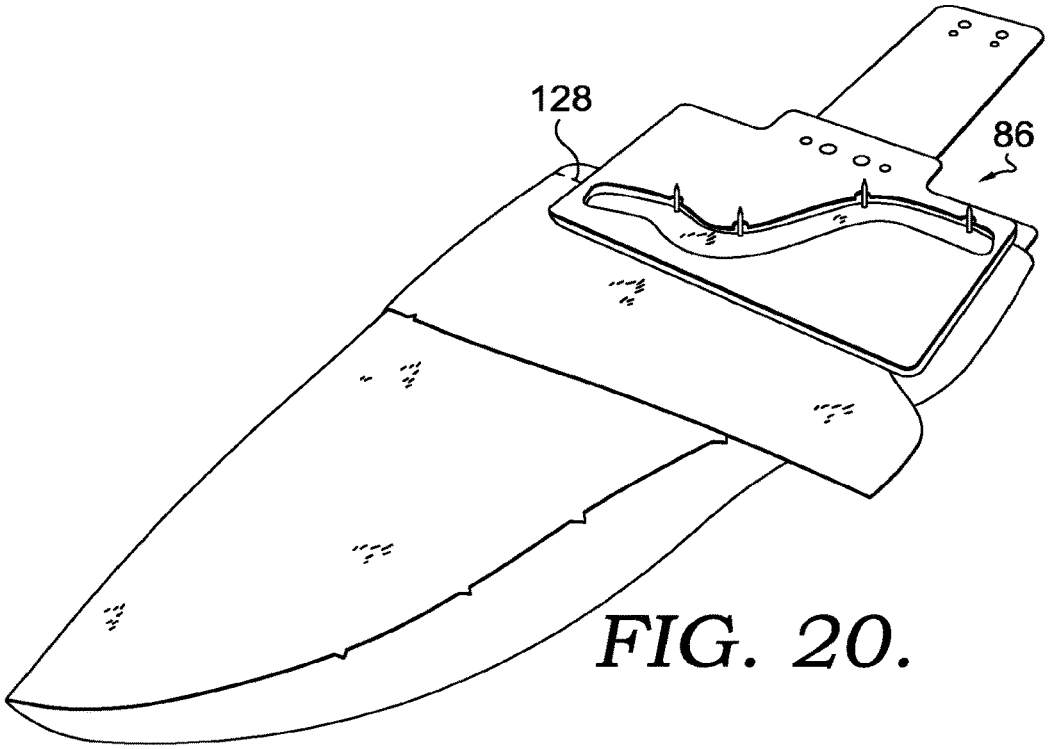
FIG. 20 depicts a top perspective view of a jig that is the mirror image of the jig of FIG. 11 with the shoe upper and a heel liner secured thereto after a portion of the collar seam has been stitched, in accordance with exemplary aspects hereof.

Referring to FIGS. 11, 19, and 20, once the upper 46 and the liner 88 are secured to the jig, the stitching operation can automatically take place. As described herein, the upper 46 can have a closed collar edge 80. It is this closed collar edge that limits the stitching system 82 to effectuating only one half of a collar seam a time. More specifically, the closed collar edge 80 must be fit around the width of the jig 84 when the respective apertures 104 are positioned on their respective pins 102. It is the closed nature of the upper collar edge 80 (formed by connecting the back edges 48 and 50 as described herein) that dictates the size of the jig 84. In fact, because of the varying sizes of shoes (and thus, varying sizes of closed collar edges), it may be necessary to have multiple sizes of the jig 84. The path/shape of edge 100 allows for efficient positioning of the closed collar edge 80 on the pins 102 because it exposes the pins 102 directly to the closed collar edge 80. Because the material of which an upper is usually made of is expandable, it is possible to stitch more than 180 degrees around the closed collar edge 80. However, as is apparent, it is also necessary to have two separate stitching operations due to the closed circular nature of the closed collar edge 80. With the jig upper member 108 in its raised position, the closed upper 46 is first place on the jig lower member 92 by positioning the apertures 104 on the pins 102. The closed upper 46 is in an inside out configuration when placed on the jig lower member 92. The liner 88 is then place on top of the closed upper 46 by positioning the apertures 106 on the pins 102. The liner 88 is position on the jig lower member 92 such that a surface 124 which will ultimately face a wearer's foot is closest to the closed upper 46. In this manner, once the collar stitching is compete, the joined closed upper 46 and the liner 88 can be turned right side out so that the center back seam and the collar seam are hidden in the final shoe. The jig upper member 108 can then be automatically actuated downwardly by plate 36 to further secure the upper 46 and the liner 88 in the jig 84. A stitch pattern (not shown) can be loaded from the memory of a computing device electronically coupled to the stitching machine 10. The pattern will have the general configuration of the stitching edge 100 and the stitching aperture 110, which is also the general shape of one half of the collar seam of a closed shoe upper. In the current example, one half of the collar seam is an elongated wave shaped line, but, as is apparent, any other sort of seam configuration could be used (for instance a zig-zag line or a curved line) by picking the appropriate pattern and a corresponding shape to the edge 100 and the aperture 110. The positioning mechanism 22 and the stitching head 16 will be automatically actuated to perform a stitch operation based upon the pattern. More specifically, the positioning mechanism 22 will move the jig 44 in the desired X and Y directions 26 and 28 (based upon the pattern) below the stitching head 16 as it is actuated. The presser foot arrangement 18 operates in conjunction with the base aperture 20 to form one half of the collar seam. Once the stitch operation is over, the jig upper member 108 will automatically be moved upwardly and the now joined closed upper 46 and liner 88 are removed from the jig lower member 92 by removing the apertures 104 and 106 from the pins 102.

Figure 14:
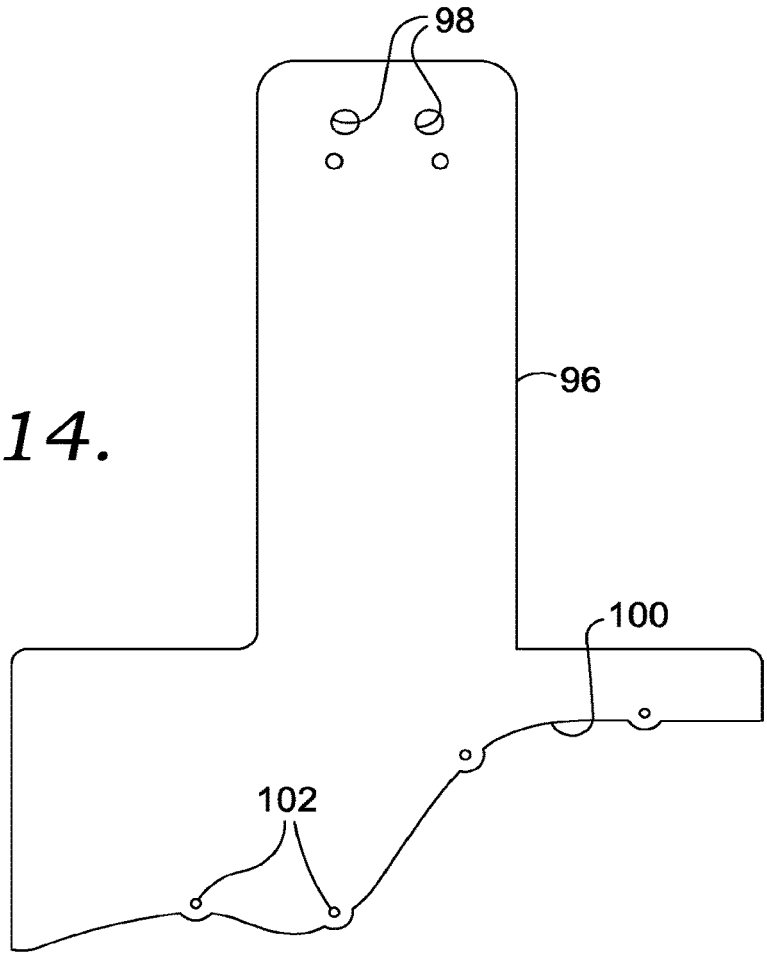
FIG. 14 depicts a top plan view of the lower member of the jig of FIG. 20, which is a mirror image of the jig lower member of FIG. 12, in accordance with exemplary aspects hereof.
Figure 15:
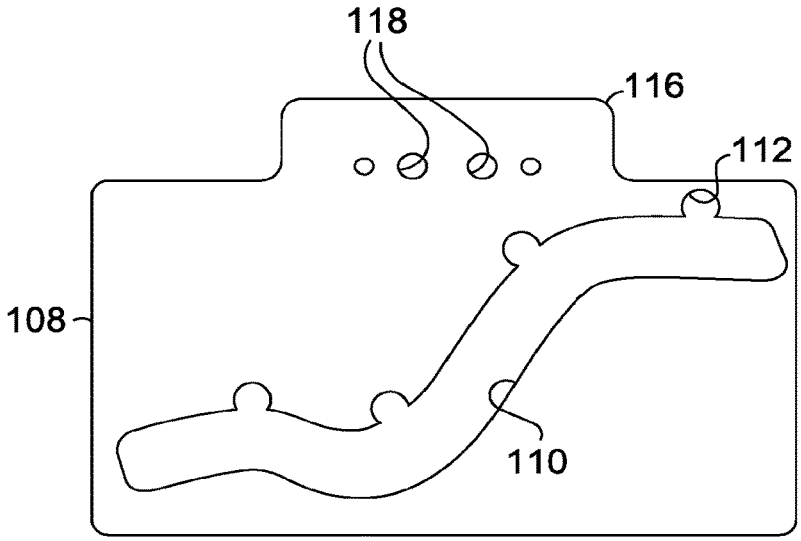
FIG. 15 depicts a top plan view of the upper member of the jig of FIG. 20, which is a mirror image of the jig upper member of FIG. 13, in accordance with exemplary aspects hereof.

Referring to FIG. 20, a portion 128 of a collar seam is depicted. The portion 128 was formed by the operation described above utilizing the jig 84. The same procedure is now performed to join the other half of the upper collar edge 80 with the other half of the liner collar edge 90 utilizing the mirror image jig 86. Referring to FIGS. 14 and 15, the mirror images of the jig lower member 96 and the jig upper member 108 are depicted for use in the jig 86. Once the stitching operation with the jig 86 is performed and entire collar seam formed, the closed upper 46 and the attached liner 88 can be turned right side out to form the finished upper.

Figure 16:
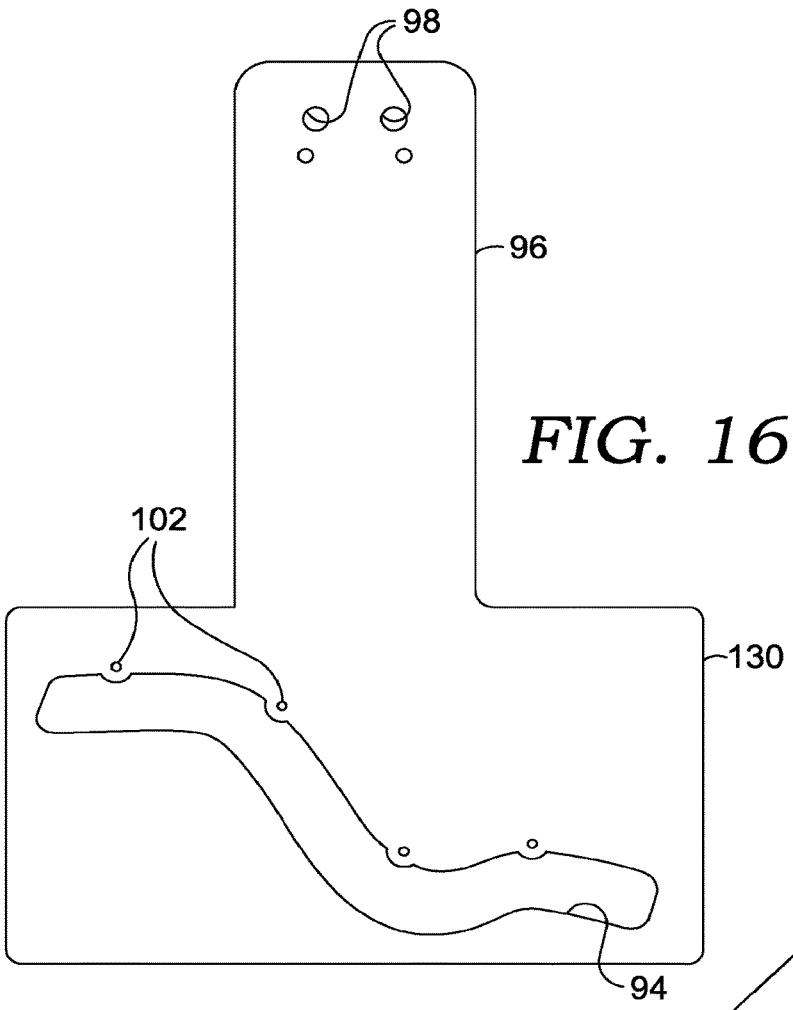
FIG. 16 depicts an alternative lower member of the jig of FIG. 11, in accordance with exemplary aspects hereof.

Referring to FIG. 16, another aspect hereof is depicted in the form of an alternative jig lower member 130 to be used in place of jig lower member 92 of the jigs 84 and 86. More specifically, the jig lower member 130 is similar to jig lower member 92 in that it has mounting pins 102 and a connecting flange 96. However, the lower member 130 has an aperture 94 formed therein. The alternate lower member 130 is used in conjunction with the same jig upper member 108 and in the same manner as the jig lower member 92. The aperture 94 of the jig lower member 130 is the same shape and coincides with the aperture 110 of the jig upper member 108. This alternative jig lower member 130 does not offer the ease of positioning of the upper 46 and the liner 88 on the pins 102 because the additional material used to form the aperture 94 requires additional stretching of the closed collar edge 80. However, in some circumstances the aperture 94 may provide additional support.

The jigs 44, 84, and 86 can be made of any suitable stiff material or combination of materials, for instance, but not limited to metal, fiberglass, and/or plastic.

As is apparent, the system herein provides an automated manner of intricately connecting two shoe parts without significant human interaction. This is far from the traditional manual stitching operations that are very labor intensive and provide inconsistent results. The use of an electronically stored pattern ensures consistent manufacturing time after time. Efficiencies of manufacture are also greatly enhanced.

Figure 21:
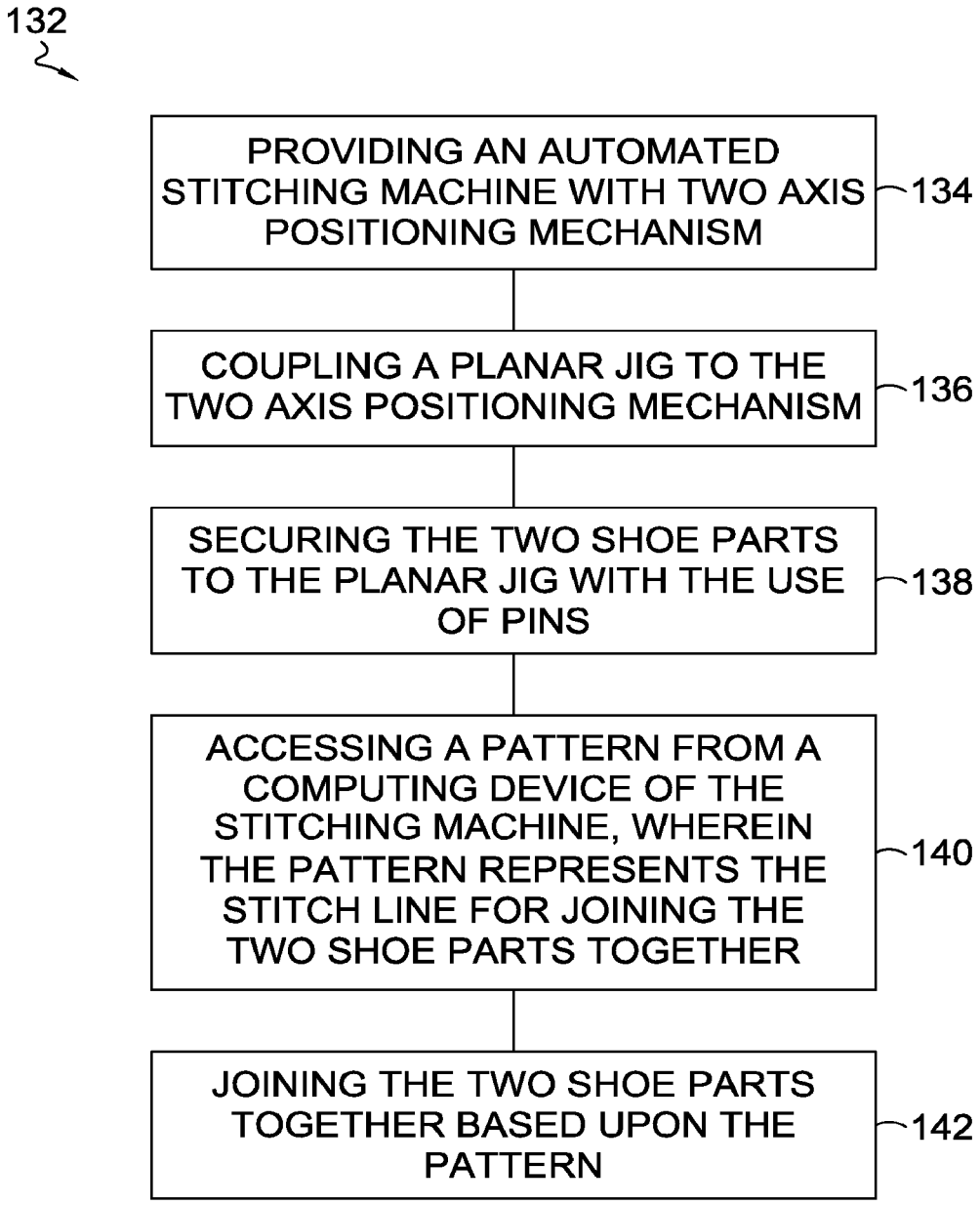
FIG. 21 depicts a flow diagram representing a method for joining two shoe parts in a specific fashion, in accordance with exemplary aspects hereof.

FIG. 21 depicts a flow diagram representing a method 132 for joining two shoe parts together in a specific manner. It is contemplated that while a specific order of steps is presented and discussed that alternative ordering may be implemented without departing from the scope of the aspects provided herein. At a first block 134, a step represents providing an automated stitching machine with a two axis positioning mechanism. At a block 136, a step represents coupling a planar jig to the two axis positioning mechanism. At a block 138, a step represents securing the two shoe parts to the planar jig with the use of pins. At a block 140, a step represents accessing a pattern from a computing device of the stitching machine. The pattern represents the stitch line for joining the two shoe parts together. At a block 142, a step represents joining the two shoe parts together based upon the pattern.

Figure 22:
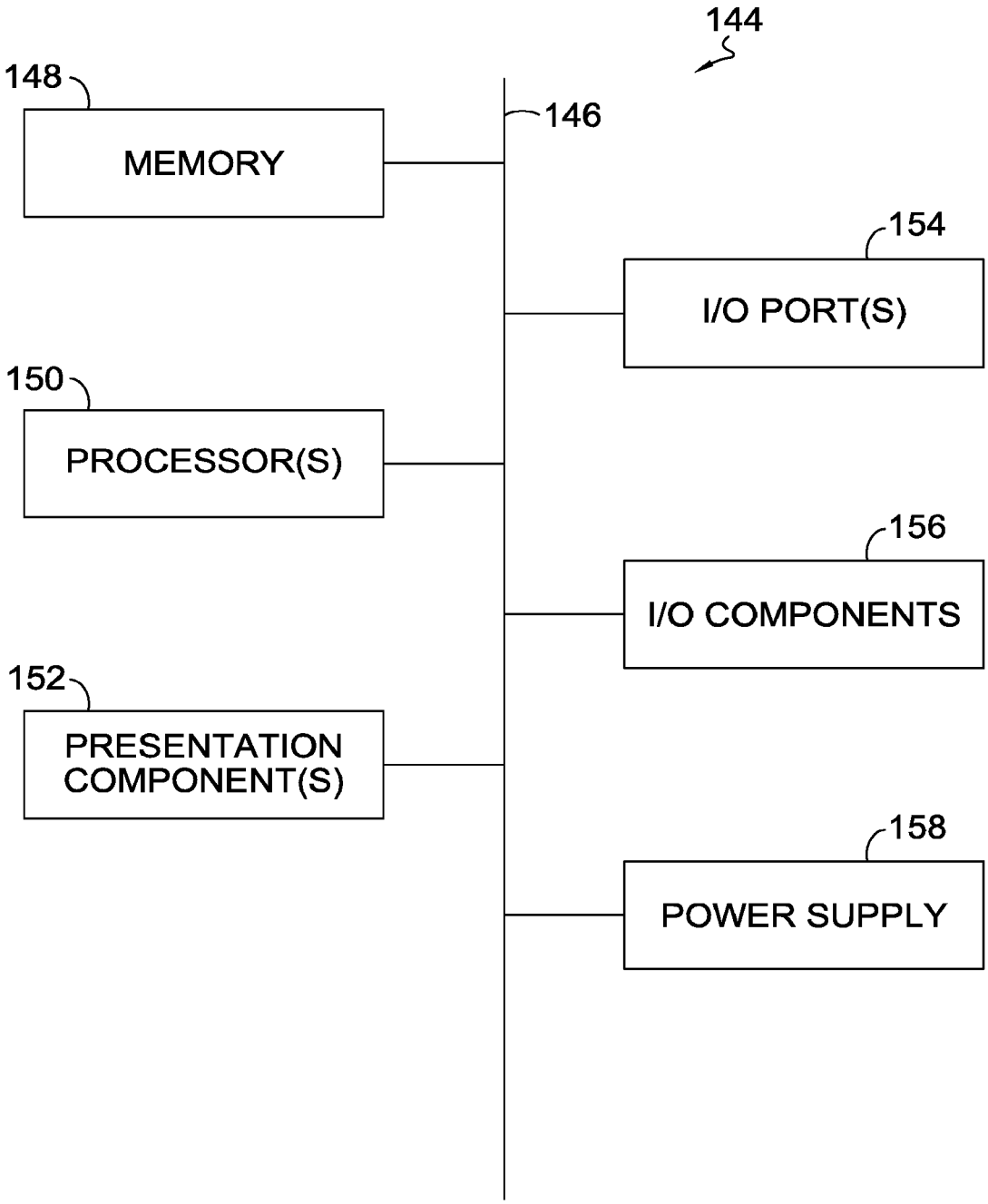
FIG. 22 depicts an exemplary computing operating environment, such as a programmable logic controller and/or a personal computer, for implementing aspects of hereof.

FIG. 22 depicts an exemplary computing operating environment for implementing aspects hereof as shown and designated generally as computing system or device 144. For example, aspects provided herein contemplate using a computing device 144 to store patterns, to control the positioning mechanism 22, and to actuate stitching head 16 so as to automatically stitch two shoe parts together. The computing device 144 is but one example of a suitable computing environment and is not intended to suggest any limitation as to the scope of use or functionality of the invention. Neither should the computing device 144 be interpreted as having any dependency or requirement relating to any one or combination of components illustrated.

Aspects hereof may be described in the general context of computer code or machine-useable instructions, including computer-executable instructions such as program components, being executed by a computer or other machine, such as a programmable logic controller ("PLC"). Generally, program components, including routines, programs, objects, components, data structures, and the like, refer to code that performs particular tasks or implements particular abstract data types. Aspects hereof may be practiced in a variety of system configurations, including handheld devices, consumer electronics, general-purpose computers, personal computers, specialty computing devices, PLC, etc. Aspects hereof may also be practiced in distributed computing environments where tasks are performed by remote-processing devices that are linked through a communications network.

With continued reference to FIG. 22, computing device 144 includes a bus 146 that directly or indirectly couples the following devices: memory 148, one or more processors 150, one or more presentation components 152, input/output (I/O) ports 154, I/O components 156, and an illustrative power supply 158. The bus 146 represents what may be one or more busses (such as an address bus, data bus, or combination thereof). Although the various blocks of FIG. 22 are shown with lines for the sake of clarity, in reality, delineating various components is not so clear, and metaphorically, the lines would more accurately be grey and fuzzy. For example, one may consider a presentation component such as a display device to be an I/O component 156. Also, processors have memory. It is recognized that such is the nature of the art, and reiterated that the diagram of FIG. 22 is merely illustrative of an exemplary computing device that can be used in connection with one or more aspects hereof. Distinction is not made between such categories as "workstation," "server," "laptop," "handheld device," "tablet," "phone," "node," "PLC," etc., as all are contemplated within the scope of FIG. 22 and refer to "computer" or "computing device." In particular, aspects hereof are contemplated as being performed in whole or in part on one or more components of a distributed computing system. It is contemplated that a distributed computing system may be comprised of processors, networks, and memory that scale to handle a desired level of computing processes at a time. Therefore, it is contemplated that a computing device may also refer to the computing environment of a distributed computing system that dynamically changes with time and/or demand.

Computing device 144 typically includes a variety of computer-readable media. Computer-readable media can be any available media that can be accessed by computing device 144 and includes both volatile and nonvolatile media, removable and non-removable media. By way of example, and not limitation, computer-readable media may comprise computer-storage media and communication media. Computer-storage media includes both volatile and nonvolatile, removable and non-removable media implemented in any method or technology for storage of information such as computer-readable instructions, data structures, program modules or other data.

Computer-storage media includes RAM, ROM, EEPROM, flash memory or other memory technology, CD-ROM, digital versatile disks (DVD) or other optical disk storage, magnetic cassettes, magnetic tape, magnetic disk storage or other magnetic storage devices. Computer storage media does not comprise a propagated data signal.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 148 includes computer-storage media in the form of volatile and/or nonvolatile memory. The memory 148 may be removable, nonremovable, or a combination thereof. Exemplary memory includes non-transitory, solid-state memory, hard drives, optical-disc drives, etc. Computing device 144 includes one or more processors 150 that read data from various entities such as bus 146, memory 148 or I/O components 156. Presentation component(s) 152 present data indications to a person or other device. Exemplary presentation components 152 include a display device, speaker, printing component, vibrating component, etc. I/O ports 154 allow computing device 144 to be logically coupled to other devices including I/O components 156, some of which may be built in. Illustrative I/O components 156 include a microphone, joystick, game pad, satellite dish, scanner, printer, wireless device, etc.

The invention claimed is:

1. A jig capable of joining two shoe parts and capable of being used in an automated stitching machine, the jig comprising:

a lower member capable of being operably coupled to the automated stitching machine; and an upper member capable of being operably coupled to the automated stitching machine, the upper member further comprising a connecting flange and a stitching aperture, wherein the stitching aperture comprises a first end located proximal to the connecting flange, and a second end located distal to the connecting flange, and wherein the stitching aperture further comprises a plurality of semi-circular cutouts;

wherein the two shoe parts are held in place between the lower member and the upper member and wherein the lower member, the upper member and the two shoe parts there between are moved by the automated stitching machine in accordance with a pattern stored in the automated stitching machine.

2. The jig of claim 1, wherein a layer of compressible material is added to a surface of one of the lower member and the upper member so that the layer of compressible material engages the at least one of the two shoe parts to assist holding the two shoe parts in place during stitching.

3. The jig of claim 1, wherein the lower member has a distal edge at a location distal from the automated stitching machine, and wherein the distal edge has a general shape of a stitch line connecting the two shoe parts.

4. The jig of claim 1, wherein the two shoe parts are the medial and lateral sides of a one piece upper and a seam formed is a back vertical seam of the shoe upper.

5. The jig of claim 1, wherein the two shoe parts are at least a portion of the shoe upper and at least a portion of a heel liner.

6. The jig of claim 5, wherein the jig forms a stitch line for one of the medial and lateral sides of a collar region of the shoe.

7. The jig of claim 1, wherein at least one of the lower member and the upper member has at least one pin for receiving at least one of the two shoe parts.

8. The jig of claim 7, wherein there is a plurality of pins and the plurality of pins generally follow a stitch line connecting the two shoe parts.

9. The jig of claim 8, wherein at least one of the two shoe parts has an aperture formed therein to receive the plurality of pins.

10. The jig of claim 1, wherein the upper member and the lower member are planar.

11. A system for stitching two shoe parts together comprising:

an stitching machine including a head with a needle;

a positioning mechanism operatively coupled to the stitching machine and capable of movement along an X-axis and a Y-axis;

a planar jig for positioning the two shoe parts with respect to one another and removably coupled to the positioning mechanism, and a computing device for controlling actuation of the needle and the positioning mechanism such that the planar jig can be manipulated to provide a specific stitch arrangement for connecting the two shoe parts;

wherein the planar jig includes a distal edge at a location distal from the positioning mechanism and having a configuration that follows a general shape of the specific stitch arrangement for connecting the two shoe parts, wherein the distal edge of the planar jig further comprises a plurality of semi-circular cutouts.

12. The system of claim 11 wherein the planar jig includes:

a lower member capable of being operably coupled to the positioning mechanism; and an upper member capable of being operably coupled to the positioning mechanism;

wherein the two shoe parts are held in place between the lower member and the upper member and wherein the lower member, the upper member and the two shoe parts there between are moved by the stitching machine in accordance with a pattern stored in the stitching machine.

13. The system of claim 12, wherein a layer of compressible material is added to a surface of one of the lower member and the upper member so that the layer of compressible material engages at least one of the two shoe parts to assist holding the two shoe parts in place during stitching.

14. The system of claim 12 wherein the two shoe parts are the medial and lateral sides of a once piece upper and a seam formed is a back vertical seam of the shoe upper, and wherein the distal edge is part of an aperture formed in the planar jig.

15. The system of claim 12, wherein the two shoe parts are at least a portion of a shoe upper and at least a portion of a heel liner.

16. The system of claim 15, wherein the planar jig forms a stitch line for one of the medial and lateral sides of a collar region of the shoe upper.

17. The system of claim 12, wherein at least one of the lower member and the upper member has at least one pin for receiving at least one of the two shoe parts.

18. The system of claim 17, wherein there is a plurality of pins and the plurality of pins generally follow a stitch line used to join the two shoe parts, such that the plurality of semi-circular cutouts are sized to receive the plurality of pins.

19. A method of joining two shoe parts together in a specific fashion, the method comprising:

providing an automated stitching machine with a two axis positioning mechanism;

coupling a planar jig to the two axis positioning mechanism, wherein the planar jig comprises an upper member and a lower member, the upper member further comprising a connecting flange and a stitching aperture, wherein the stitching aperture comprises a first end located proximal to the connecting flange, and a second end located distal to the connecting flange;

securing the two shoe parts to the planar jig with the use of pins;

accessing a pattern from a computing device of the automated stitching machine, wherein the pattern represents a stitch line for joining the two shoe parts together; and joining the two shoe parts together based upon the pattern.

* * * * *